US010025261B2

(12) United States Patent
Suzuki et al.

(10) Patent No.: US 10,025,261 B2
(45) Date of Patent: Jul. 17, 2018

(54) IMAGE FORMING APPARATUS

(71) Applicant: CANON KABUSHIKI KAISHA, Tokyo (JP)

(72) Inventors: Tatsuya Suzuki, Kawasaki (JP); Noritomo Yamaguchi, Kawasaki (JP); Yuichi Fukui, Yokosuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/405,103

(22) Filed: Jan. 12, 2017

(65) Prior Publication Data

US 2017/0123371 A1 May 4, 2017

Related U.S. Application Data

(63) Continuation of application No. 14/548,022, filed on Nov. 19, 2014, now Pat. No. 9,599,957.

(30) Foreign Application Priority Data

Nov. 20, 2013 (JP) ..... 2013-240147

(51) Int. Cl.
*G03G 21/16* (2006.01)

(52) U.S. Cl.
CPC ..... *G03G 21/1647* (2013.01); *G03G 21/1671* (2013.01)

(58) Field of Classification Search
CPC ..... G03G 21/1807; G03G 21/1609; G03G 2215/0132; G03G 21/1853; G03G 15/0189; G03G 15/0178
See application file for complete search history.

(56) References Cited

U.S. PATENT DOCUMENTS 7,778,570 B2 * 8/2010 Numagami ..... G03G 15/0142 399/111
2013/0028629 A1 * 1/2013 Yoshikawa ..... G03G 15/0189 399/101
2013/0308976 A1 * 11/2013 Sekido ..... G03G 21/1842 399/110

FOREIGN PATENT DOCUMENTS

CN 1797236 A 7/2006
CN 101206427 A 6/2008
CN 101802723 A 8/2010

* cited by examiner

*Primary Examiner* — Gregory H Curran
(74) *Attorney, Agent, or Firm* — Canon U.S.A., Inc. IP Division

(57) ABSTRACT

An image forming apparatus includes: a supporting member supporting multiple cartridges and movable between an inside position inside an apparatus main body and an outside position, in which the cartridges are supported arrayed in a direction of extracting the supporting member from the inside position to the outside position, with the multiple cartridges being detachably attachable at the outside position; a first cartridge; a second cartridge adjacent to the first cartridge; and a third cartridge adjacent to the second cartridge. The first cartridge has a greater protrusion amount from the supporting member compared to the second cartridge and the third cartridge, in a direction orthogonal to the extracting direction and to a longitudinal direction of the cartridges. When viewed from the orthogonal direction, the amount of overlapping between the first cartridge and the second cartridge is greater than the amount of overlapping between the second cartridge and the third cartridge.

10 Claims, 11 Drawing Sheets

IMAGE FORMING APPARATUS

The Current Application claims the benefit of priority from U.S. application Ser. No. 14/548,022 filed on Nov. 19, 2014, which claims the benefit of priority from Japanese Patent Application No. 2013-240147 filed on Nov. 20, 2013, which are hereby incorporated by reference herein in their entirety.

BACKGROUND OF THE INVENTION

Field of the Invention

The present invention relates to an image forming apparatus to which a cartridge is detachably attachable.

An image forming apparatus forms images on a recording medium using an electrophotographic process. Examples of image forming apparatuses include electrophotographic copying machines, electrophotographic printers (light emitting diode (LED) printers, laser beam printers, etc.), electrophotographic facsimile apparatuses, electrophotographic word processors, and so forth. A cartridge is a process detachably attached to the image forming apparatus main body, which acts upon a photosensitive drum (developing agent bearing member). An image forming apparatus main body is the part of the image forming apparatus from which the cartridge has been excluded.

Description of the Related Art

Conventionally, image forming apparatuses using the electrophotographic process have a photosensitive drum, and a process unit which acts upon the photosensitive drum, formed integrally as a cartridge. The cartridge is detachably attachable to the image forming apparatus main body of the image forming apparatus, thereby realizing the process cartridge system.

This process cartridge system enables the user to perform maintenance of the image forming apparatus without depending on a serviceman, which has markedly improved operability.

One configuration for detachably attaching such a process cartridge involves extracting the process cartridge loaded on a supporting member (e.g., Japanese Patent Laid-Open No. 2006-184901).

However, in recent years there has been demand for longer life spans of process cartridges and also increased capacity of toner, in such systems. Answering such demands while also reducing the size of the image forming apparatus is a problem, which is being address by optimizing the location of components within the image forming apparatus. In particular, both increased capacity of process cartridges and reduction in size of the image forming apparatus are being realized in full-color image forming apparatuses, which use multiple process cartridges that take up a great deal of space, by situating the process cartridges in a highly-dense manner with no space therebetween. However, situating the process cartridges in a highly-dense manner may lead to poor usability regarding detaching/attaching and so forth, which may be a constraint regarding further reduction in size.

SUMMARY OF THE INVENTION

An image forming apparatus which forms images on a recording medium includes: a supporting member configured to support a plurality of cartridges and to be movable between an inside position which is inside an apparatus main body of the image forming apparatus and an outside position which is outside of the apparatus main body, in which the plurality of cartridges are supported arrayed in a direction of extracting the supporting member from the inside position to the outside position, with the plurality of cartridges being detachably attachable at the outside position; a first cartridge which is one of the plurality of cartridges; a second cartridge which is one of the plurality of cartridges and which is adjacent to the first cartridge; and a third cartridge which is one of the plurality of cartridges and which is adjacent to the second cartridge. The first cartridge has a greater protrusion amount from the supporting member as compared to the second cartridge and the third cartridge, in a direction orthogonal to the extracting direction and to a longitudinal direction of the cartridges. When viewed from the orthogonal direction, the amount of overlapping between the first cartridge and the second cartridge is greater than the amount of overlapping between the second cartridge and the third cartridge.

Further features of the present invention will become apparent from the following description of exemplary embodiments with reference to the attached drawings.

DESCRIPTION OF THE EMBODIMENTS

Preferred embodiments for carrying out the present invention will be exemplarily described in detail, with reference to the drawings. It should be noted however, that functions, materials, and forms, of component parts, and relative placement thereof, described in the embodiments are not to be interpreted as restricting the scope of the present invention to those description, unless specifically stated to that effect. Also, functions, materials, and forms, of members described herein are to be understood to be the same in subsequent description, unless no new description is made in particular.

First Embodiment

A first embodiment of the present invention will now be described. The present embodiment exemplarily illustrates an image forming apparatus regarding which four process cartridges can be detachably attached, as the image forming apparatus. It should be noted, however, that the number of process cartridges to be attached to the image forming apparatus is not restricted to this; the number is to be set as appropriate. A printer is exemplarily illustrated as one form of an image forming apparatus in the present embodiment.

Schematic Configuration of Image Forming Apparatus

Figure 2:
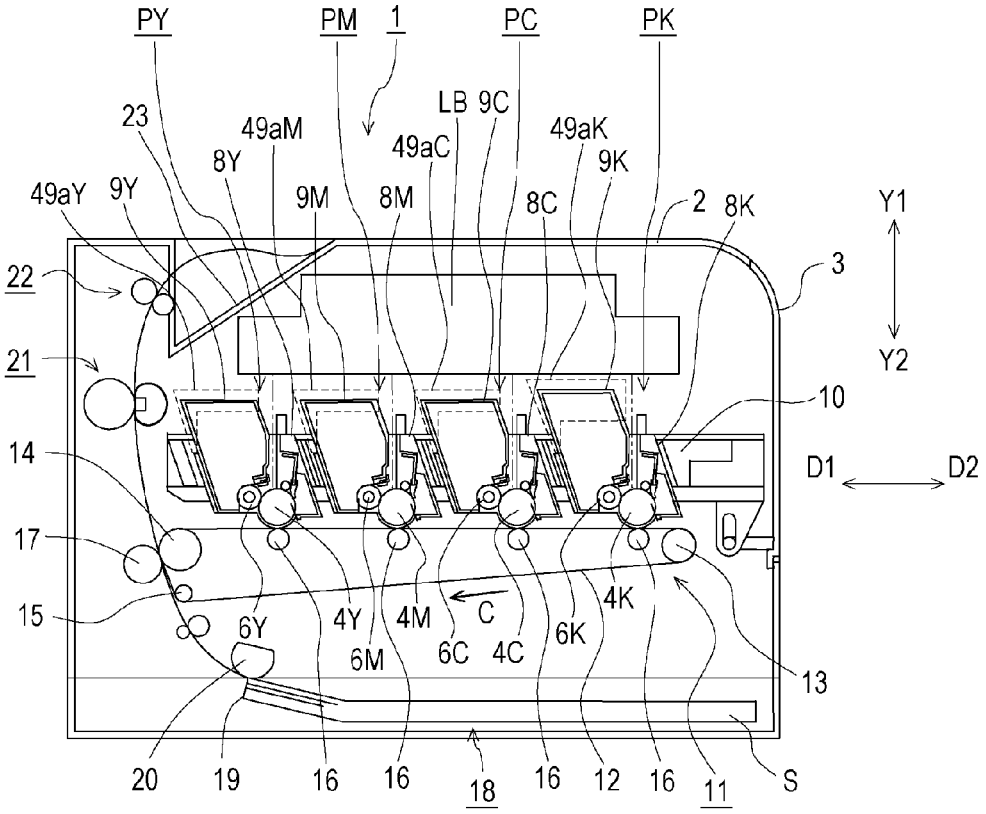
FIG. 2 is a cross-sectional schematic view of an image forming apparatus according to the first embodiment.
Figure 3:
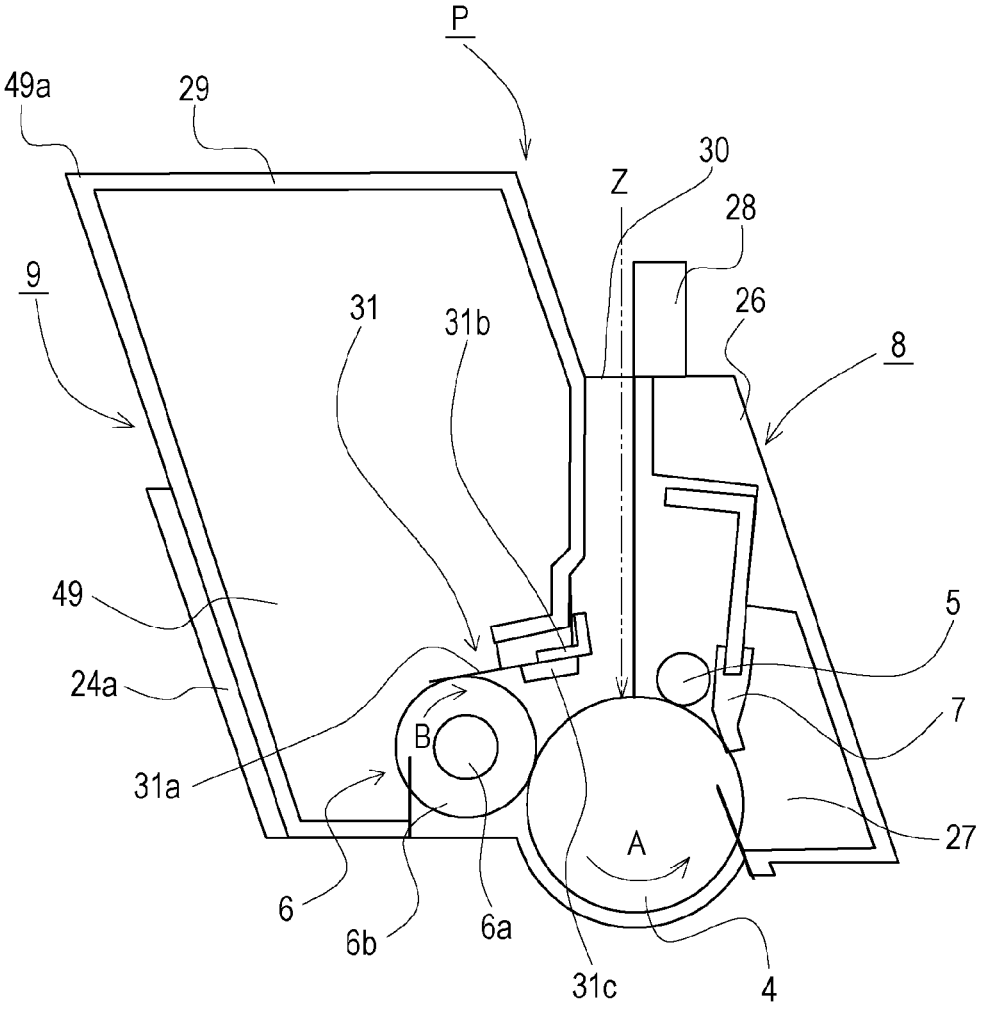
FIG. 3 is a cross-sectional schematic diagram of a process cartridge according to the first embodiment.
Figure 4:
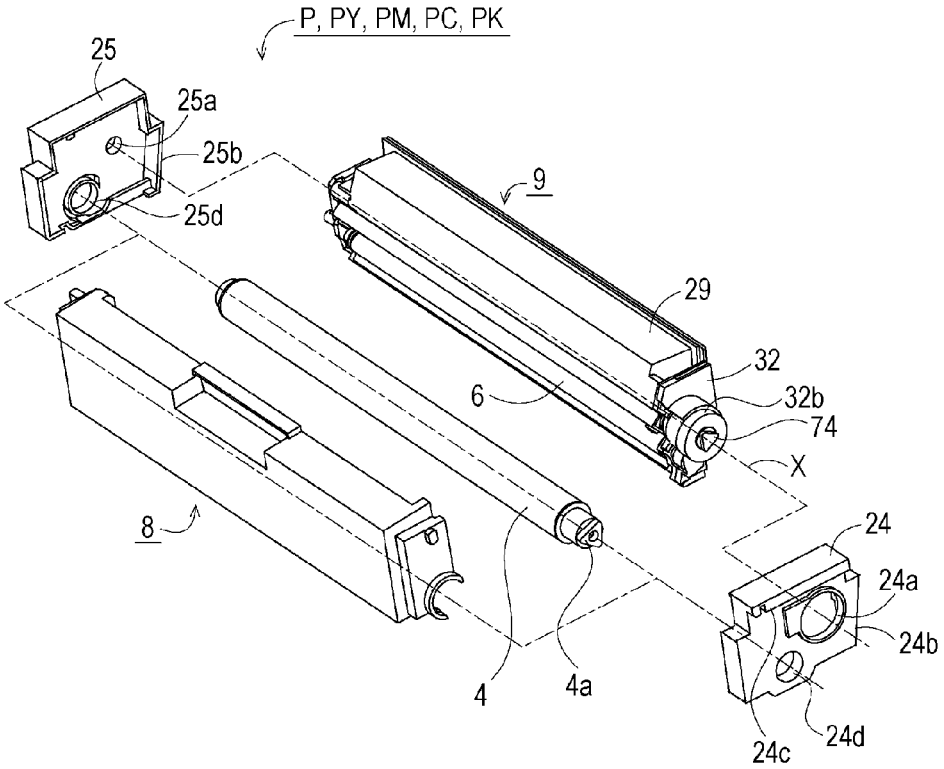
FIG. 4 is a disassembled perspective view of the process cartridge according to the first embodiment.
Figure 5:
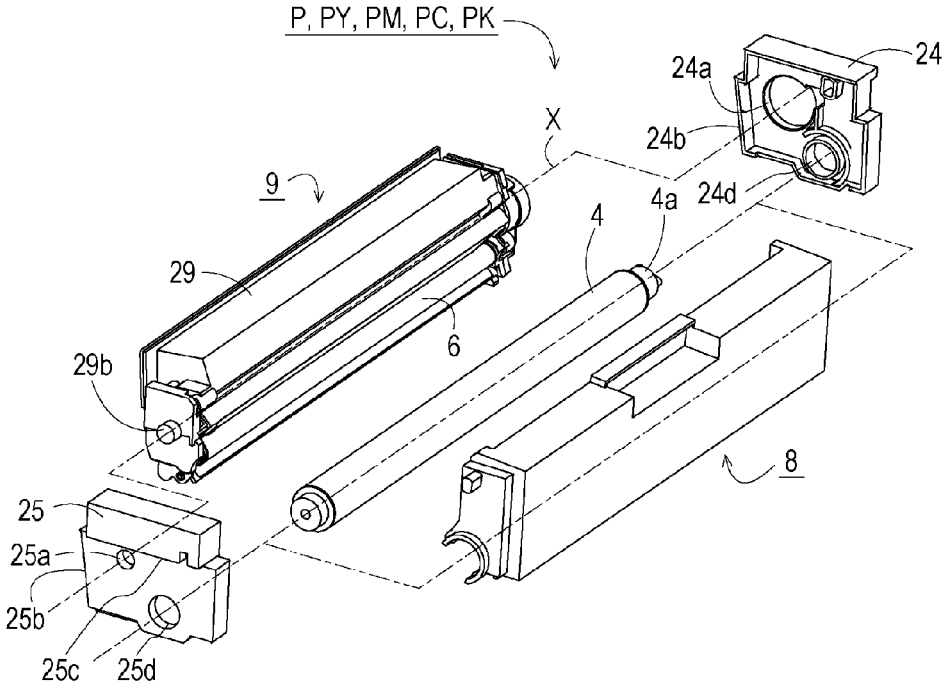
FIG. 5 is a disassembled perspective view of the process cartridge according to the first embodiment.

FIG. 2 illustrates a schematic cross-sectional view of an image forming apparatus 1 according to the present invention, and FIG. 3 illustrates a cross-sectional view of a process cartridge (hereinafter, also "cartridge") P according to the present embodiment. Also, FIG. 4 is a disassembled perspective view of the cartridge P according to the present embodiment, as viewed from a drive side, which is one side of in an axial direction (hereinafter, also referred to as "longitudinal direction") a photosensitive drum 4. FIG. 5 is a disassembled perspective view of the cartridge P according to the present embodiment, as viewed from a non-drive side, which is the other side of in the longitudinal direction of the photosensitive drum 4.

The image forming apparatus 1 is a four-color full-color laser printer which uses the electrophotographic process to color form images on a recording medium S. The image forming apparatus 1 forms color images on the recording medium S with cartridges detachably attached to an image forming apparatus main body 2.

A side of the image forming apparatus 1 where a front door 3 is provided will be referred to as the front face, and the face opposite the front face as the back face (rear face). When viewed from the front of the image forming apparatus 1, the right side will also be referred to as a drive side, and the left side as a non-drive side. FIG. 2 is a cross-sectional view of the image forming apparatus 1 from the non-drive side, so the near side in the drawing is the non-drive side of the image forming apparatus 1, and the far side is the drive side of the image forming apparatus 1.

Four cartridges P (PY, PM, PC, and PK) are disposed in the image forming apparatus main body 2 in the horizontal direction. These are a first cartridge PY, a second cartridge PM, a third cartridge PC, and a fourth cartridge PK. The first through fourth cartridges P (PY, PM, PC, and PK) each have the same electrophotographic process mechanism, with different color developing agents (hereinafter also referred to as "toner"). The first through fourth cartridges P (PY, PM, PC, and PK) have rotational driving force transmitted thereto by a driving output unit (omitted from illustration) of the image forming apparatus main body 2. Also supplied to the first through fourth cartridges P (PY, PM, PC, and PK) is bias voltage (charging bias and developing bias) from the image forming apparatus main body 2. This supply of bias voltage is also omitted from illustration.

As illustrated in FIG. 3, the first through fourth cartridges P (PY, PM, PC, and PK) each have a drum unit 8. Each drum unit 8 includes a photosensitive drum 4, and a charging device and cleaning device serving as process devices to act upon the photosensitive drum 4. The first through fourth cartridges P (PY, PM, PC, and PK) each have a developing unit 9. Each developing unit 9 includes a developing device which develops electrostatic latent images on the photosensitive drum 4. The drum unit 8 and developing unit 9 are joined to each other. Detailed configurations of the cartridges P will be described later.

The first cartridge PY accommodates yellow (Y) toner in a developing agent container 29, and forms yellow toner images on the surface of its photosensitive drum 4Y. The second cartridge PM accommodates magenta (M) toner in a developing agent container 29, and forms magenta toner images on the surface of its photosensitive drum 4M. The third cartridge PC accommodates cyan (C) toner in a developing agent container 29, and forms cyan toner images on the surface of its photosensitive drum 4C. The fourth cartridge PK accommodates black (K) toner in a developing agent container 29, and forms black toner images on the surface of its photosensitive drum 4K.

Provided above the first through fourth cartridges P (PY, PM, PC, and PK) is a laser scanner unit LB serving as an exposure device. This laser scanner unit LB outputs a laser beam Z corresponding to image information. The laser beam Z passes through an exposure window 30 of the cartridge P, and performs scanning exposure on the surface of the photosensitive drum 4.

Provided below the first through fourth cartridges P (PY, PM, PC, and PK) is an intermediate transfer belt unit 11 serving as a transfer member. The intermediate transfer belt unit 11 includes a driving roller 13, a turn roller 14, and a tension roller 15, over which a flexible transfer belt 12 runs.

The lower faces of the photosensitive drums 4 of the first through fourth cartridges P (PY, PM, PC, and PK) come into contact with the upper face of the transfer belt 12. The contact portions form a primary transfer portion. A primary transfer roller 16 is situated on the inner side of the transfer belt 12, one facing each photosensitive drum 4.

A secondary transfer roller 17 is disposed abutting against the turn roller 14 across the transfer belt 12. The portion of contact of the transfer belt 12 and secondary transfer roller 17 forms a secondary transfer portion.

A sheet feed unit 18 is disposed beneath the intermediate transfer belt unit 11. The sheet feed unit 18 includes a sheet feed tray 19 where a recording medium S is stacked and accommodated, and a sheet feed roller 20.

A fixing unit 21 and a discharge unit 22 are provided at the upper left within the image forming apparatus main body 2, as illustrated in FIG. 2. The upper face of the image forming apparatus main body 2 serves as a discharge tray 23. A toner image is fixed on a recording medium S by a fixing device provided to the fixing unit 21, and the recording medium S is discharged onto the discharge tray 23.

Image Forming Operations

Operations for forming a full-color image are as follows. The photosensitive drums 4 of the first through fourth cartridges P (PY, PM, PC, PK) are rotationally driven at a predetermined speed (direction A in FIG. 3, counterclockwise direction in FIG. 2). The transfer belt 12 also is rotationally driven in the forward direction of rotation of the photosensitive drums 4 (direction of arrow C in FIG. 2), at a speed corresponding to the speed of the photosensitive drums 4.

The laser scanner unit LB is also driven. A charging roller 5 uniformly charges the surfaces of the photosensitive drums 4 to a predetermined polarity and potential, synchronously with the driving of the laser scanner unit LB. The laser scanner unit LB performs scanning exposure of the surfaces of the photosensitive drums 4 by a laser beam Z in accordance with image signals of each color. Accordingly, electrostatic latent images are formed on the surfaces of the photosensitive drums 4, corresponding to image signals of the corresponding colors. The formed electrostatic latent images are developed by a developing roller 6 rotationally driven (direction of arrow B in FIG. 3, clockwise in FIG. 2) at a predetermined speed.

As a result of such electrophotographic image forming process operations, a yellow toner image, corresponding to the yellow component of the full-color image, is formed on the photosensitive drum 4 of the first cartridge PY. This toner image is transferred as primary transfer onto the transfer belt 12.

In the same way, a magenta toner image, corresponding to the magenta component of the full-color image, is formed on the photosensitive drum 4 of the second cartridge PM. This toner image is transferred as primary transfer onto the transfer belt 12, so as to be superimposed upon the yellow toner image already transferred thereupon.

In the same way, a cyan toner image, corresponding to the cyan component of the full-color image, is formed on the photosensitive drum 4 of the third cartridge PC. This toner image is transferred as primary transfer onto the transfer belt 12, so as to be superimposed upon the yellow and magenta toner images already transferred thereupon.

In the same way, a black toner image, corresponding to the black component of the full-color image, is formed on the photosensitive drum 4 of the fourth cartridge PK. This toner image is transferred as primary transfer onto the transfer belt 12, so as to be superimposed upon the yellow, magenta, and cyan toner images already transferred thereupon. Thus, a full-color unfixed toner image, of the four colors yellow, magenta, cyan, and black, is formed upon the transfer belt 12.

On the other hand, the recording medium S is separated one sheet at a time and fed out, at a predetermined control timing. The recording medium S is guided to the secondary transfer portion, which is the abutment portion of the secondary transfer roller 17 and transfer belt 12, at a predetermined timing. Accordingly, the four-color superimposed toner images on the transfer belt 12 are transferred at once onto the face of the recording medium S as the recording medium S is being conveyed through the secondary transfer portion.

Overall Configuration of Process Cartridge

The first through fourth cartridges P (PY, PM, PC, PK) according to the present embodiment have the same electrophotographic process mechanisms, with different color toners and different amounts of toner being accommodated in each.

Each cartridge P has a photosensitive drum 4 (4Y, 4M, 4C, 4K), and a process device (charging device, developing device, and cleaning device) which act upon the photosensitive drum 4. The charging device is the charging roller 5 which charges the photosensitive drum 4. The developing device is the developing roller 6 which develops an electrostatic latent image formed on the photosensitive drum 4. Further, the cleaning device is a cleaning blade 7 which removes residual toner remaining on the surface of the photosensitive drum 4. Each cartridge P is divided into a drum unit 8 (8Y, 8M, 8C, 8K), and developing unit 9 (9Y, 9M, 9C, 9K).

Configuration of Drum Unit

As illustrated in FIGS. 3 through 5, the drum unit 8 is configured including the photosensitive drum 4, charging roller 5, cleaning blade 7, a cleaner case 26, and a waste toner accommodation section 27. The photosensitive drum 4 is rotatably supported by a one-end-side cartridge cover member 24 and an other-end-side cartridge cover member 25, disposed on either end of the cartridge P in the longitudinal direction. The one-end-side cartridge cover member 24 and other-end-side cartridge cover member 25 will be described later. Also, as illustrated in FIG. 4, a coupling member 4*a* is provided on one end of the photosensitive drum 4 in the longitudinal direction, to transmit driving force to the photosensitive drum 4. The coupling member 4*a* engages a coupling (omitted from illustration) serving as a drum driving output unit of the image forming apparatus main body 2, so that driving force of a driving motor (omitted from illustration) of the image forming apparatus main body 2 is transmitted to the photosensitive drum 4. The charging roller 5 is supported by the cleaner case 26 so as to come into contact with the photosensitive drum 4 and be rotationally driven. The cleaning blade 7 is supported by the cleaner case 26 so as to abut against the peripheral surface of the photosensitive drum 4 at a predetermined pressure. Residual toner removed from the peripheral face of the photosensitive drum 4 by the cleaning blade 7 is contained by the waste toner accommodation section 27 within the cleaner case 26.

Configuration of Developing Unit

As illustrated in FIG. 3, the developing unit 9 is configured including the developing roller 6, a developing blade 31, the developing agent container 29, and so forth. Each developing agent container 29 includes a toner accommodation section 49 (49Y, 49M, 49C, 49K)which accommodates toner to be supplied to the developing roller 6, and the developing blade 31 which restricts the toner layer thickness on the peripheral face of the developing roller 6. Note that in the present embodiment, the toner accommodation section 49K of the fourth cartridge PK is formed larger than the other toner accommodation sections 49Y, 49M, and 49C of the other cartridges PY, PM, and PC.

The developing blade 31 is formed by attaching a thin metal plate 31*a* which is sheet metal around 0.1 mm thick, to a base plate 31*b* which is an L-shaped metal member, by welding or the like. The developing blade 31 is attached to the developing agent container 29 by fixing screws 31*c* at the two positions of one end and the other end in the longitudinal direction.

The developing roller 6 is configured including a core metal 6*a* formed of a metal material, and a rubber portion 6*b*. The developing roller 6 is rotatably supported by bearing side plates, omitted from illustration, of the developing agent container 29, at both ends in the longitudinal direction so as to be rotatable.

A developing input coupling 74 is provided to the developing unit 9 at one end side of the developing unit 9 in the longitudinal direction, as illustrated in FIG. 4, to transmit the driving force thereto. The developing input coupling 74 engages a coupling (omitted from illustration) serving as a developing driving output unit of the image forming apparatus main body 2, so that driving force of a driving motor (omitted from illustration) is input to the developing unit 9. The driving force input to the developing unit 9 enables the developing roller 6 to be rotated in the direction of the arrow B in FIG. 3 by a drive train, omitted from illustration, which is provided within the developing unit 9. A developing cover member 32, which supports and covers the developing input coupling 74 and drive train, omitted from illustration, is provided on one end side of the developing unit 9 in the longitudinal direction.

Assembly of Drum Unit and Developing Unit

Assembly of the drum unit 8 and developing unit 9 will be described with reference to FIGS. 4 and 5. The drum unit 8 and developing unit 9 are joined by cartridge cover members provided on both ends of the cartridge P in the longitudinal direction (the one-end-side cartridge cover member 24 and other-end-side cartridge cover member 25 in FIG. 4). The one-end-side cartridge cover member 24 (24Y, 24M, 24C, 24K) provided on one end of the cartridge P in the longitudinal direction is provided with a supporting hole 24*a* to pivotably (movably) support the developing unit 9. The other-end-side cartridge cover member 25 (25Y, 25M, 25C, 25K) provided to the other end of the cartridge P in the longitudinal direction is provided with a supporting hole 25*a* to pivotably (movably) support the developing unit 9. Further, supporting holes 24*d* and 25*d* are provided to the one-end-side cartridge cover member 24 and the other-end-side cartridge cover member 25 respectively, to rotatably support the photosensitive drum 4. Now, an outer perimeter portion of a cylindrical portion 32*b* of the developing cover member 32 is fit into the supporting hole 24*a* of the one-end-side cartridge cover member 24. A projection 29*b* provided projecting from the developing agent container 29 is fit into the supporting hole 25*a* of the other-end-side cartridge cover member 25. Further, the ends of the photosensitive drum 4 in the longitudinal direction are fit in the supporting hole 24*d* of the one-end-side cartridge cover member 24 and the supporting hole 25*d* of the other-end-side cartridge cover member 25. The one-end-side cartridge cover member 24 and the other-end-side cartridge cover member 25 are then fixed to the drum unit 8 by screws, adhesive agent, or the like, omitted from illustration. The developing unit 9 is rotatably supported by the drum unit 8, the one-end-side cartridge cover member 24, and the other-end-side cartridge cover member 25, so that the developing roller 6 can be positioned at a position so as to act upon the photosensitive drum 4 when forming images. An axial line which connects the supporting hole 24*a* of the one-end-side cartridge cover member 24 and the supporting hole 25*a* of the other-end-side cartridge cover member 25, and which is the rotation center of the developing unit 9, will be referred to as pivot axis X or pivot center X. Note that the cylindrical portion 32*b* of the developing cover member 32 on one end is coaxial with the developing input coupling 74, meaning that the developing unit 9 receives transmission of driving force from the image forming apparatus main body 2 on its pivot center X.

Now, the first through fourth cartridges P (PY, PM, PC, PK) may not have all the same parts and the same size, as the fourth cartridge PK has been described has having a toner accommodation section 49K larger than those of the other cartridges PY, PM, and PC. The size of the cartridge P may differ one from another, depending on the toner capacity thereof, and so forth.

Configuration of Cartridge Tray (Supporting Member)

Figure 6:
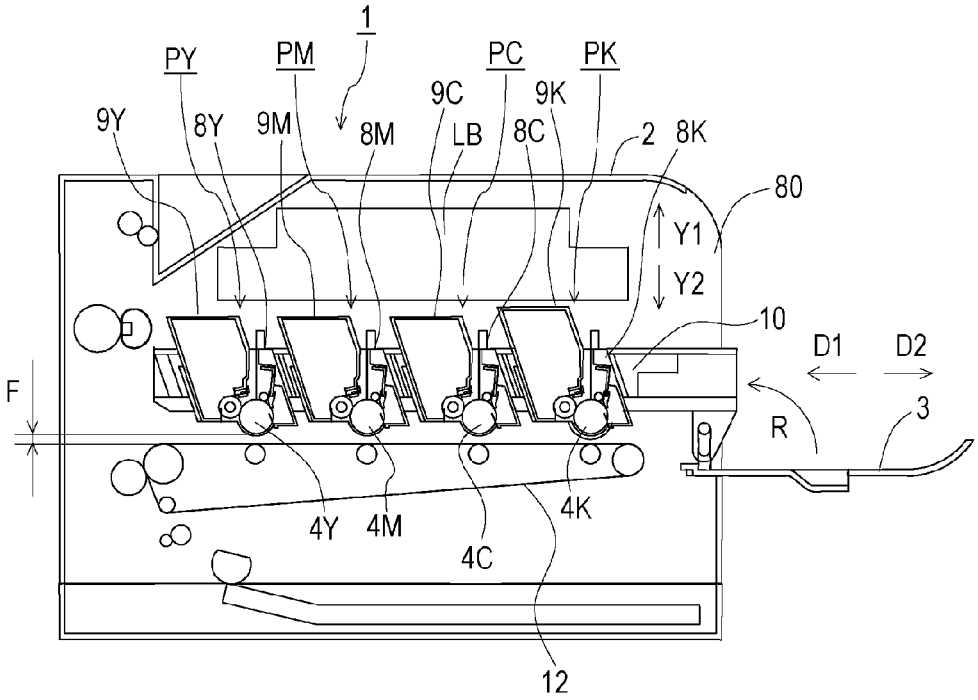
FIG. 6 is a cross-sectional schematic view of the image forming apparatus according to the first embodiment.
Figure 7:
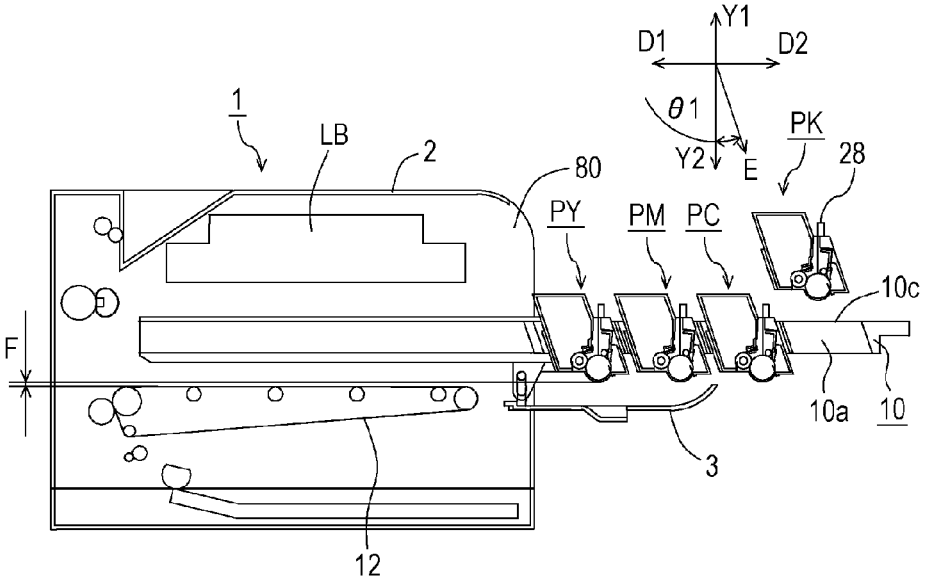
FIG. 7 is a cross-sectional schematic view of the image forming apparatus according to the first embodiment.

A cartridge tray (hereinafter, simply "tray") 10 serving as a supporting member will be described in detail with references to FIGS. 2, 6, and 7. FIG. 6 is a cross-sectional schematic view of the image forming apparatus 1 in a state where the photosensitive drum 4 is at a position away from the transfer belt 12. FIG. 7 is a cross-sectional schematic view of the image forming apparatus 1 in a state where the tray 10 is situated on the outer side of the image forming apparatus main body 2. The tray 10 can be moved with regard to the image forming apparatus main body 2 in an arrow D1 direction (being pressed in), and an arrow D2 direction (being pulled out or extracted). That is to say, the tray 10 is configured to be extracted from and pressed into the image forming apparatus main body 2. The tray 10 according to the present embodiment is configured to move in a generally horizontal direction, in a state where the image forming apparatus main body 2 has been placed on a horizontal face. Further, the tray 10 can move between an inside position where the tray 10 is situated within the image forming apparatus main body 2, and an outside position where the tray 10 is situated outside the image forming apparatus main body 2. Now, with regard to the inside position, the tray 10 can move between an image forming position, which is inside the image forming apparatus main body 2, where the cartridges P can be situated at positions where images can be formed, and a position away from the transfer belt 12, which position also is inside the image forming apparatus main body 2. FIG. 2 illustrates a case of the tray 10 being situated at the image forming position. FIG. 6 illustrates a case where the tray 10 has moved to a position where the photosensitive drums 4 of the developing rollers 6 have moved to positions away from the transfer belt 12. FIG. 7 illustrates a case where the tray 10 has moved to the outside position. In the present embodiment, all cases where the tray 10 is situated at the image forming position and the position away from the transfer belt 12, within the image forming apparatus main body 2, and all positions in between these positions, will be collectively referred to as "inside position". The tray 10 also has attaching portions 10*a* to which multiple cartridges P can be detachably attached (see FIG. 7). The cartridges P are detachably attached to the attaching portions 10*a* in a state where the tray 10 is extracted, as illustrated in FIG. 7. Each cartridge P has an engaging portion 24*c* (see FIG. 4) which is provided to the one-end-side cartridge cover member 24, and an engaging portion 25*c* (see FIG. 5) provided to the other-end-side cartridge cover member 25. A cartridge P is attached to the tray 10 by the engaging portion 24*c* and engaging portion 25*c* coming into contact with an engaging portion 10*c* (see FIG. 7) of the tray 10 and being loaded thereupon.

The cartridges P then enter (by being pushed) into the image forming apparatus main body 2 along with the tray 10, in a state of being situated in the attaching portions 10*a*. At this time, the cartridges P move in a state where the transfer belt 12 situated below and the photosensitive drums 4 maintain a certain distance F, as illustrated in FIG. 6. Accordingly, the tray 10 moves between the inside position and the outside position without the photosensitive drums 4 of the cartridges P and the transfer belt 12 coming into contact. Even in a state where the tray 10 is inserted to the deepest position, the cartridges P maintain a distanced state from the transfer belt 12. Subsequently, upon the front door 3 closing in the direction of the arrow R (FIG. 3), the tray 10 moves in the direction of the arrow Y2, and the cartridges P are positioned as to the image forming apparatus main body 2. That is to say, the tray 10 moves to the image forming position. In this state, image forming can be performed by the cartridges P. According to this configuration, multiple cartridges P can be moved inside the image forming apparatus main body 2 by the tray 10, and also can be extracted to the outside of the image forming apparatus main body 2 thereby.

Now, in a state where the cartridges P have been attached to the tray 10, the adjacent cartridges P are positioned so as to be partially overlapping in a direction perpendicular to the movement direction of the tray 10 (direction of arrows D1 or D2), i.e., in the Y1 or Y2 direction, as illustrated in FIG. 2. For example, the developing unit 9M of the second cartridge PM and the drum unit 8Y of the first cartridge PY are overlapping in the Y1 direction in this layout. As described earlier, residual toner removed from the photosensitive drum 4 is contained in the waste toner accommodation section 27 of the cleaner case 26. However, in the present embodiment the space above the drum unit 8 is not used as a waste toner accommodation section, so a portion of the adjacent cartridge P can use this space. Accordingly, the space above the drum unit 8 can be used as space to situate the toner accommodation section 49 of the adjacent cartridge P. As illustrated in FIG. 2, protruding accommodation portions 49*a* (49*a*M, 49*a*C, 49*a*K) protrude into the space above the drum units 8 (8Y, 8M, and 8C). That is to say, when viewed from a perpendicular direction (direction Y1 or Y2) to the movement direction of the tray (direction or arrows D1 or D2), the cartridges P are arranged so that the cleaner cases 26 and the protruding accommodation portions

49*a* overlap. With reference to FIG. 1, the protruding toner accommodation portions 49*a*M, 49*a*C, and 49*a*K overlap the drum units 8Y, 8M, 8C of the cartridges PY, PM, and PC upstream in the moving direction of the tray 10, by overlapping amounts La (LaM, LaC, and LaK) in the extracting direction of the tray 10 (D2 direction).

Further, a part of the developing units 9 of the cartridges P protrude beyond the drum units 8 of the cartridges P adjacent in the upstream direction in the extracting direction (direction of arrow D2) of the tray 10, by a protruding amount Lb (LbM, LbC, LbK) in the vertical upward direction (direction of arrow Y1). For example, a part of the developing unit 9M of the second cartridge PM protrudes beyond the drum unit 8Y by a protruding amount LbM in the Y1 direction.

Figure 11:
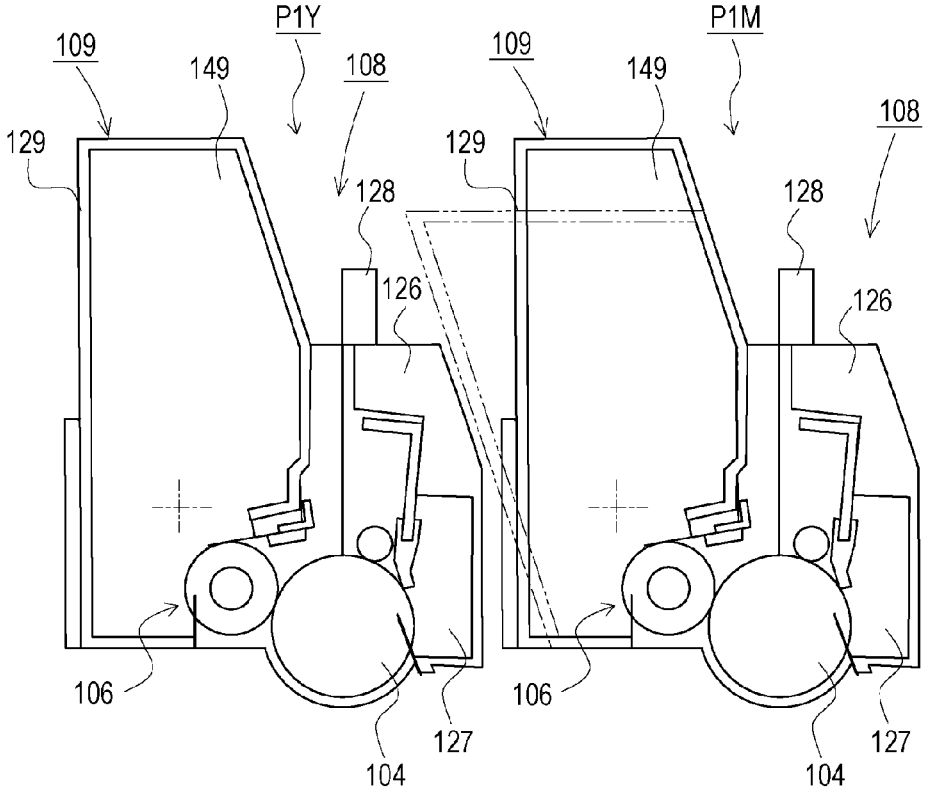
FIG. 11 is a cross-sectional view of process cartridges according to conventional comparative example.

FIG. 11 illustrates a comparative example of conventional cartridges P1 arrayed not partially overlapping when viewed from a direction perpendicular to the movement direction of the tray 10 (direction of arrows D1 or D2). In this arrangement, the height of the cartridges P1 has to be increased in order to accommodate the same amount of toner in a toner accommodation section 149. Accordingly, the height of the toner accommodation section 149 of the conventional cartridge P1 has to be made higher than that of the cartridge P according to the present embodiment, in order to accommodate the same amount of toner in the toner accommodation section 149 as in that of the cartridge P according to the present embodiment. Thus, the cartridge P can increase the capacity of the cartridge P as compared to the conventional cartridge P1, while reducing the height of the cartridge P.

Attaching Process Cartridge to Image Forming Apparatus Main Body

Figure 8:
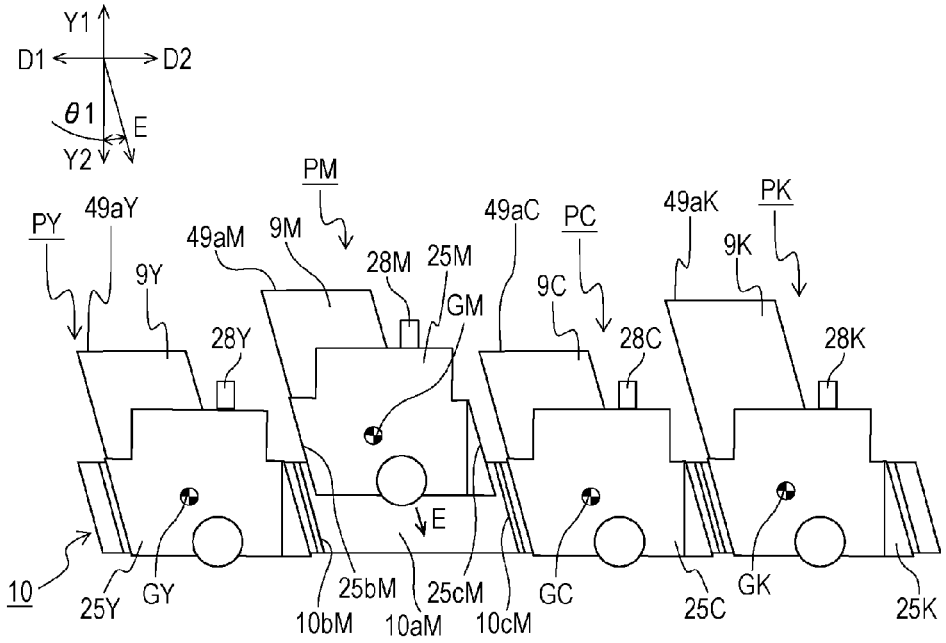
FIG. 8 is a side view of the process cartridges and supporting members according to the first embodiment.

Next, attaching of the cartridges P to the image forming apparatus main body 2 will be described with reference to FIGS. 1 and 8. FIG. 1 is a side view illustrating a state where the cartridges P have been attached to the tray 10, and a state where a cartridge P is yet to be attached, as viewed from the other end.

The cartridges P are attached to the attaching portions 10*a* of the tray 10 extracted to the outside position, as illustrated in FIG. 7. In the present embodiment, adjacent cartridges P are positioned so as to be partially overlapping in a direction perpendicular to the movement direction of the tray 10 (direction of arrows D1 or D2), i.e., in the Y1 or Y2 directions. Accordingly, in order to attach to the tray 10 without adjacent cartridges P interfering, the cartridges P are attached following a mounting direction (E direction) inclined by an angle θ1 from the direction perpendicular to the movement direction of the tray 10 (direction of arrows D1 or D2), i.e., in the Y1 or Y2 directions. Here, the overlapping amount La, in the direction of the arrow D2 of the developing unit 9 of one cartridge P and the drum unit 8 of the cartridge P which is adjacent in the upstream direction, changes by movement of the cartridge P in the E direction. That is to say, in the configuration illustrated in FIGS. 1 and 8, the developing unit 9M of the second cartridge PM passes above the drum unit 8Y of the first cartridge PY in the vertical direction. The overlapping amount LaM of the developing unit 9M of the second cartridge PM and the drum unit 8Y of the first cartridge PY in the direction of the arrow D2 gradually decreases as movement of the second cartridge PM in the direction E progresses. Accordingly, adjacent cartridges P which are positioned so as to be partially overlapping in a direction perpendicular to the movement direction of the tray 10 (direction of arrows D1 or D2), i.e., in the Y1 or Y2 directions, can be mounted to the tray 10 without interfering. Note that the cartridges P can be extracted from the tray 10 without interfering with adjacent cartridges P, by moving the cartridges P in the opposite direction of the mounting direction (direction of arrow E). Accordingly, there is no need to first extract the downstream side cartridges P in the extracting direction of the tray 10 (direction of arrow D2) first in order to extract a cartridge P upstream in the extracting direction of the tray 10 (direction of arrow D2). That is to say, the cartridge P realizes increased capacity with reduced height by accommodating toner in the protruding accommodation portion 49*a*, and the image forming apparatus 1 uses multiple such cartridges P, but the cartridges P can be attached and detached without restriction in order. This provides good usability for exchanging the cartridges P.

Figure 1A:
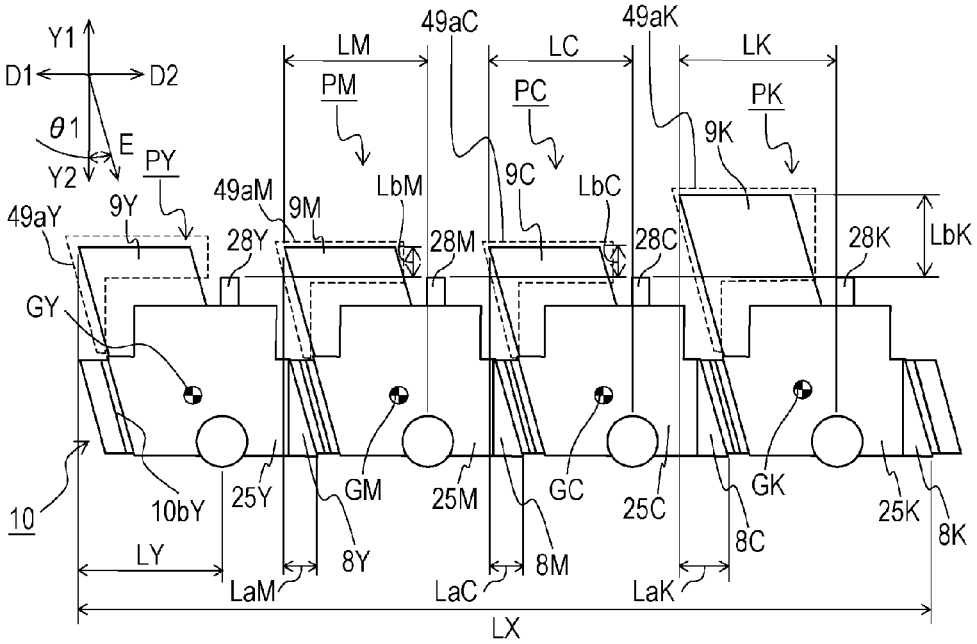
FIGS. 1A and 1B are side views of process cartridges and supporting members according to a first embodiment.
Figure 1B:
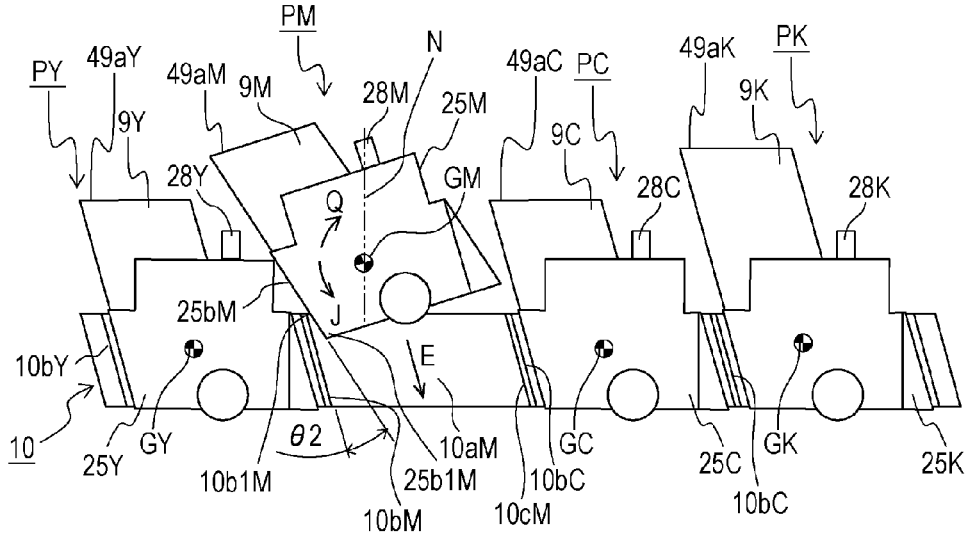

As illustrated in FIGS. 1A and 1B, 3, 7, and 8, the cartridges P each have a gripping portion 28 (28Y, 28M, 28C, 28K) on the upper face of the drum unit 8, downstream in the extracting direction of the tray 10 (the direction of the arrow D2). The gripping portion 28 is formed integrally with the cleaner case 26, and is provided such that the gripping portion 28 can be gripped to perform the attaching/detaching of the cartridges P to and from the tray 10. The tray 10 has guide portions 10*b* (10*b*Y, 10*b*M, 10*b*C, 10*b*K) for when attaching the cartridges P to the attaching portions 10*a* (10*a*Y, 10*a*M, 10*a*C, 10*a*K). The guide portions 10*b* are formed as inclined faces from the downstream side of the attaching direction (direction of the arrow E) toward the upstream side, inclined to the upstream side in the extracting direction of the tray 10, i.e., in the direction of the arrow D1. The guide portions 10*b* are set so as to be generally parallel to the attaching direction (direction of the arrow E) in the present embodiment. On the other hand, the cartridges P have guided portions 24*b* and 25*b* for attaching to the tray 10, as illustrated in FIGS. 4 and 5. The guided portions 24*b* and 25*b* are configured as inclined faces from the downstream side of the attaching direction (direction of the arrow E) toward the upstream side, inclined to the upstream side in the extracting direction of the tray 10, i.e., in the direction of the arrow D1. In a state where the cartridges P are attached to the tray 10, the guided portions 25*b* are set generally parallel to the guide portions 10*b* in the present embodiment, as illustrated in FIGS. 1A and 1B regarding the other end of the cartridges P. That is to say, the guided portions 25*b* are also generally parallel to the attaching direction (direction of the arrow E). Although omitted from illustration in FIGS. 1A and 1B, guide portions of the tray 10 are generally parallel with the guided portions 24*b* in the same way as the one end side. The guided portions 24*b* and 25*b* of the present embodiment are integrally provided to the one-end-side cartridge cover member 24 and other-end-side cartridge cover member 25 of the ends of the cartridges P in the longitudinal direction, as illustrated in FIGS. 4 and 5.

The position of the center-of-gravity G as viewed from the longitudinal direction of the cartridges P of the present embodiment illustrated in FIGS. 1A and 1B is at a position deviated in the D1 direction, which is the upstream direction in the extracting direction of the tray 10 from the gripping portion 28. Now, the attitude of the cartridges P placed in the tray 10 is the basic attitude for when placing the cartridges P outside of the image forming apparatus main body 2. Taking the second cartridge PM as an example, in a case of gripping the gripping portion 28M, rotation moment centered on the gripping portion 28M is generated due to the own weight acting on the center of gravity GM of the second cartridge PM. Accordingly, the second cartridge PM assumes an attitude rotated in the direction of the arrow J in FIG. 1B when attaching to the tray 10 is completed. At this time, the second cartridge PM has assumed an attitude where a line N connecting the gripping portion 28M and the center of gravity GM is generally parallel with the vertical direction.

The process of attaching the cartridges P to the tray 10 will be described in further detail with reference to FIGS. 1A and 1B, with regard to the cartridges P and tray 10 described above. The process of attaching the second cartridge PM to the tray 10 will be described here regarding the other end side of the second cartridge PM. Note that this is the same for the other cartridges PY, PC, and PK and the one end side as well, detailed description of which will be omitted.

First, referencing FIG. 1B, when holding the gripping portion 28M at the time of attaching the second cartridge PM to the tray 10, the second cartridge PM is in a state rotated in the direction of the arrow J, as described above. At this time, the guided portion 25*b*M has relative angle θ2 as to the guide portion 10*b*M. The second cartridge PM having such an attitude is positioned so that a guide portion front edge 10*b*1M is positioned in contact with the guided portion 25*b*M, as illustrated in FIG. 1B. The guided portion 25*b*M is slid over the guide portion front edge 10*b*1M from this state so that the second cartridge PM descends under gravity. According to this operation, the second cartridge PM is rotated in a direction where the angle θ2 becomes smaller as the guided portion 25*b*M conforms to the guide portion 10*b*M as the attaching process progresses. This is because the rotational moment due to the own weight of the second cartridge PM acting on the center of gravity GM of the second cartridge PM in the direction of the arrow Q, with the point of contact of the second cartridge PM as to the guide portion front edge 10*b*1M as the center of rotation. The attaching process of the second cartridge PM progresses while rotating as described above, and the guided portion 25*b*M becomes generally parallel with the guide portion 10*b*M. Finally, attaching of the second cartridge PM to the attaching portion 10*a*M is completed (FIG. 1A). Accordingly, the user does not have to take into consideration the direction of attaching, and can easily complete mounting of the cartridge P to the tray 10 simply by positioning the guided portions 25*b*M and 24*b*M against the guide portion 10*b*M to begin with. Also as described above, the one-end-side cartridge cover member 24 and other-end-side cartridge cover member 25 are fixed to the drum unit 8.

That is to say, the guided portions 24*b* and 25*b* are integrally formed with the gripping portion 28 which is integrally formed with the drum unit 8, so the guided portions 24*b* and 25*b* move integrally with the gripping portion 28. On the other hand, in a configuration where the guided portions are integrally formed with the developing unit 9 which is pivotable as to the gripping portion 28, the position of the guided portions may change long with the developing unit 9 when gripping the gripping portion 28. Accordingly, the present configuration facilitates positioning of the guided portions 24*b* and 25*b* as to the guide portion 10*b* when attaching the cartridges P to the tray 10 while gripping the gripping portion 28.

The above operation is performed for multiple cartridges P, and the tray 10 is moved in the direction of the arrow D1 in a state where all of the cartridges P are attached. Thus, all cartridges P enter into the inside of the image forming apparatus main body 2 through an opening 80. Accordingly, the cartridges P enter the image forming apparatus main body 2 following the direction of movement of the tray 10 (direction of arrows D1 or D2) which is generally orthogonal to the longitudinal direction of the cartridges P.

According to the above-described configuration, multiple cartridges P are arrayed in high density, and both increased volume of the cartridges P and reduction in size of the image forming apparatus 1 are realized, while providing an image forming apparatus 1 and cartridges P with excellent usability. Note that in the present embodiment, the angle θ1 is 10° and the angle θ2 is 20°, in a relationship of angle θ1<relative angle θ2. However, the magnitude relationship of the angle θ1 and relative angle θ2 is not restricted in obtaining the advantages of the present invention. Accordingly, a relationship where angle θ1=relative angle θ2, or where angle θ1>relative angle θ2, may be employed.

As described earlier, in the cartridge P according to the present embodiment, the protruding accommodation portion 49*a* which is a part of the toner accommodation section 49 is situated protruding above the drum unit 8 of the adjacent cartridge P by a protrusion amount Lb. Particularly, as illustrated in FIGS. 1A and 1B, the protruding accommodation portion 49*a*K of the fourth cartridge PK protrudes further in the upward (Y1 direction) and tray 10 pressing direction (D1 direction) as compared to the protruding accommodation portions 49*a*Y, 49*a*M, and 49*a*C, of the other cartridges PY, PM, and PC. That is to say, when viewed from the extracting direction of the tray 10 (D2 direction), protrusion amount LbK>protrusion amounts LbM and LbC. Also, if the distance between the center of the photosensitive drum 4 and the protruding accommodation portion 49*a* along the D1-D2 direction is represented by L, this distance LK in the fourth cartridge PK is greater than the distances LY, LM, and LC of the other cartridges PY, PM, and PC. That is to say, when viewed from the extracting direction of the tray 10 (direction D2) and the direction orthogonal to the axial direction of the photosensitive drum 4 (Y2 direction), the overlapping amount LaK>overlapping amounts LaM and LaC. The fourth cartridge PK has been located furthest downstream in the extracting direction of the tray 10 (direction of arrow D2). Other than a case where the fourth cartridge PK is situated at the furthest upstream side (where the first cartridge PY is situated) in the extracting direction of the tray 10 (direction of the arrow D2), including the location according to the present embodiment, the protruding accommodation portion 49*a*K is situated adjacent to the drum unit 8 of another cartridge P. If the width of the tray 10 in the direction of movement of the tray 10 (direction of arrows D1 and D2), in a state where the tray 10 has all cartridges P mounted thereupon, is expressed as LX, the distance LK of the fourth cartridge PK does not affect the distance LX within the range where the protrusion amount LaK does not obscure the gripping portion 28 of the cartridge P adjacent to the fourth cartridge PK as viewed from the direction of the arrow Y2. In the same way, the distance LX is not affected even if the distance LM of the second cartridge PM or the distance LC of the cartridge PC is made to be the same as LK. Accordingly, increasing the capacity of one or more of the cartridges PM, PC, and PK in the configuration according to the present embodiment does not affect the size of the image forming apparatus 1 in the direction of extracting the tray 10. Accommodating toner in the protruding accommodation portions 49*a* thus enables particular cartridges PK, PC, and PM to have larger volume within increasing the size of the image forming apparatus 1. Now, the fourth cartridge PK accommodating the back toner is detachably attached furthest downstream in the extracting direction of the tray 10 (direction of arrow D2), and the cartridges PY, PM, and PC, other than black, are detachably attached at the upstream side in the extracting direction of the tray 10 (direction of arrow D2). Accordingly, the lifespan of the fourth cartridge PK for black toner can be extended, and replacement frequency reduced.

Second Embodiment

Cartridges and an image forming apparatus according to a second embodiment of the present invention will be described with reference to FIGS. 9 and 10. Note that in the present embodiment, the cartridges themselves are the same as in the first embodiment, and only the direction of movement of the supporting member of the image forming apparatus is different. Accordingly, members having the same functions and configuration are denoted with the same reference numerals, and detailed description thereof will be omitted.

Figure 9:
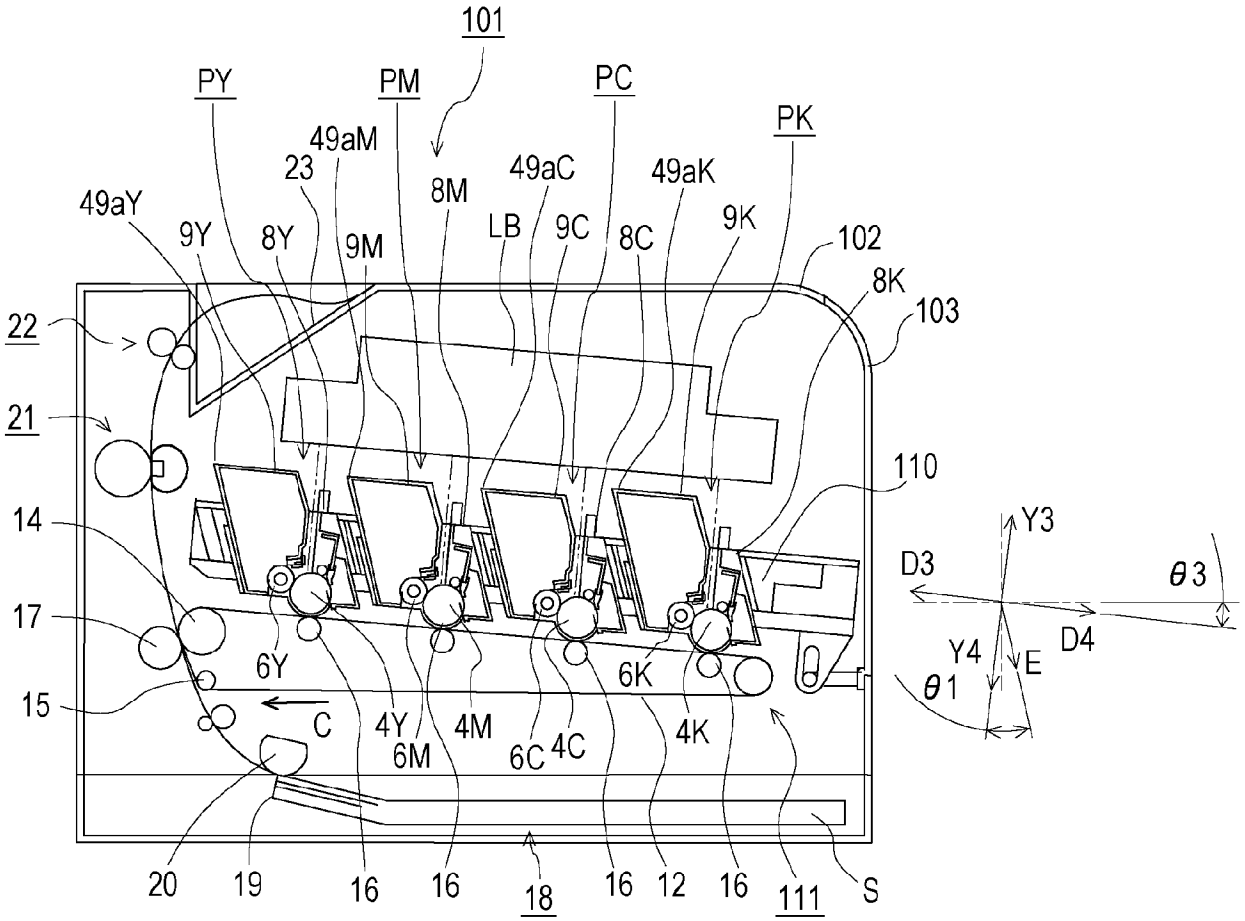
FIG. 9 is a cross-sectional schematic view of an image forming apparatus according to a second embodiment.
Figure 10:
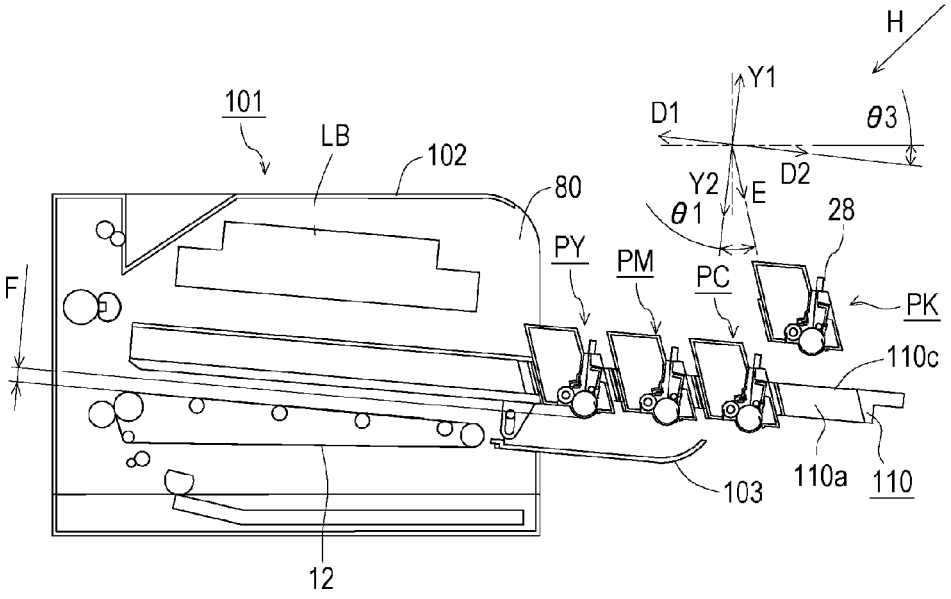
FIG. 10 is a cross-sectional schematic view of the image forming apparatus according to the second embodiment.

FIG. 9 is a cross-sectional diagram illustrating a state where a tray 110 is situated at the image forming position. FIG. 10 is a cross-sectional diagram illustrating a state where the tray 110 is situated outside the image forming apparatus.

As illustrated in FIG. 9, the tray 110 is disposed so that the downstream side of the tray 110 in the direction of being extracted (direction of arrow D4) is at an angle θ3 downwards from the horizontal direction, in a state where the image forming apparatus main body 2 is placed on a horizontal surface. The tray 110 is configured so as to be moveable in the direction an angle θ3 downwards from the horizontal direction (direction of arrows D3 and D4). Accordingly, the multiple cartridges P (PY, PM, PC, PK) according to the present embodiment are arranged so that a part of adjacent cartridges P overlap in a perpendicular direction (direction of arrows Y3 and Y4) to the direction of movement of the tray 110 (direction of arrows D3 and D4). Also, the cartridges P are attached following an attaching direction (direction E) which is inclined by an angle θ1 from the perpendicular direction (direction of arrows Y3 and Y4) to the direction of movement of the tray 110 (direction of arrows D3 and D4), so as not to interfere with each other. Now, at the time of attaching a cartridge P, the cartridge P is moved such that the overlapping distance La in the direction of the arrow Y3 between the developing unit 9 of the cartridge P and the drum unit 8 of the cartridge P adjacent upstream in the D4 direction, changes. Accordingly, cartridges P arrayed so as to partially overlap adjacent cartridges P in the perpendicular direction (direction of arrows Y3 and Y4) to the direction of movement of the tray 110 (direction of arrows D3 and D4) can be attached to the tray 110 without interference. The cartridges P also can be removed from the tray 110 without interference with adjacent cartridges P by moving the cartridges P in the opposite direction as to the attaching direction (direction E). Accordingly, there is no need to extract the cartridge P downstream in the extracting direction of the tray 110 (direction of arrow D4) first, in order to extract upstream cartridges P. That is to say, the cartridge P realizes increased capacity with reduced height by accommodating toner in the protruding accommodation portion 49*a*, and the image forming apparatus 1 uses multiple such cartridges P, but the cartridges P can be attached and detached without restriction in order. This provides good usability for exchanging the cartridges P.

In the present embodiment as well, the one-end-side cartridge cover member 24 and other-end-side cartridge cover member 25 are fixed to the drum unit 8. That is to say, the guided portions 24*b* and 25*b* are integrally formed with the gripping portion 28 which is integrally formed with the drum unit 8. Accordingly, the guided portions 24*b* and 25*b* move integrally with the gripping portion 28, so the guided portions 24*b* and 25*b* can easily be positioned as to the guide portion 10*b* when attaching the cartridge P to the tray 110 gripping the gripping portion 28.

Also, the attaching direction of the cartridges P (direction E in the drawings) is closer to the vertical direction by the angle θ3 as compared to a case where the direction of movement of the tray 110 is parallel. Accordingly, the amount of rotation centered on the center of gravity G when attaching and detaching the cartridges P to and from the tray 110 is smaller, and thus can be attached in detached more naturally in the gravitational direction. Assuming a case where the user stands at the direction of the front door 3 of the image forming apparatus 1 and views the image forming apparatus 1 from the direction of the arrow H in FIG. 10, the user will be viewing the attaching portion 110*a* of the tray 110 more straight on rather than at an angle, due to the movement direction of the tray 110 being inclined by the angle θ3 as compared to horizontal, thereby improving visual recognition. This further facilitates the attaching and detaching work of the cartridges P.

According to the embodiments described above, large-capacity cartridges can be arrayed in high density to realize reduction in size of the image forming apparatus, while improving usability of attaching cartridges.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus which forms images on a recording medium, the image forming apparatus comprising:

a supporting member supporting a first photosensitive drum, a second photosensitive drum, and a third photosensitive drum and including attaching portions to which a plurality of cartridges are attached and configured to support the plurality of cartridges and to be movable between an inside position which is inside an apparatus main body of the image forming apparatus and an outside position which is outside of the apparatus main body, in which the plurality of cartridges are supported arrayed in an extracting direction of extracting the supporting member from the inside position to the outside position, with the plurality of cartridges being detachably attachable at the outside position;

an exposure device exposing the first photosensitive drum, the second photosensitive drum, and the third photosensitive drum along an exposing direction in a plane perpendicular to a longitudinal direction of the cartridge;

wherein the plurality of cartridges includes a first cartridge, a second cartridge, and a third cartridge, wherein the first cartridge comprises a first developing roller corresponding to the first photosensitive drum, the second cartridge comprises a second developing roller corresponding to the second photosensitive drum, and the third cartridge comprises a third developing roller corresponding to the third photosensitive drum, wherein the first cartridge, the second cartridge, and the third cartridge are arranged in this order in a direction parallel to the extracting direction, wherein when viewed along the longitudinal direction, a side surface of the first cartridge facing to the second cartridge is a surface inclining toward an orthogonal direction that is orthogonal to the extracting direction and the longitudinal direction of the cartridge and inclining toward the exposing direction, and wherein, with respect to the extracting direction, a first distance between the first photosensitive drum and an upper end of the side surface of the first cartridge is greater than a second distance between the second photosensitive drum and an upper end of the second cartridge side.

2. The image forming apparatus according to claim 1, wherein, the first cartridge is attached to a first attaching portion of the attaching portions provided at a position farthest at the downstream side in the extracting direction.

3. The image forming apparatus according to claim 1, wherein a portion of the first cartridge of which the protruding amount from the supporting member is greater than that of the second cartridge and the third cartridge is an accommodating portion configured to accommodate developing agent.

4. The image forming apparatus according to claim 1, wherein each of the plurality of cartridges include an accommodating portion configured to accommodate a developing agent.

5. The image forming apparatus according to claim 4, wherein the first cartridge contains black developing agent, and the second cartridge and third cartridge contain developing agent of a color other than black.

6. The image forming apparatus according to claim 1, wherein the supporting member includes a plurality of guide portions configured to guide the attaching and detaching of a corresponding cartridge to and from the supporting member, and wherein the plurality of guide portions so guide the corresponding cartridge to be attached to and detached from the supporting member without interference with an adjacent cartridge.

7. The image forming apparatus according to claim 1, wherein the supporting member includes a plurality of guide portions configured to guide the attaching of a corresponding cartridge to the supporting member, and the attaching direction of the cartridges as to the supporting member inclines as to the orthogonal direction, and the cartridges are attached to the supporting member from the upstream side toward the downstream side of the extracting direction.

8. The image forming apparatus according to claim 1, wherein the extracting direction is inclined downwards as to the horizontal direction.

9. The image forming apparatus according to claim 1, wherein the longitudinal direction is an axial direction of the developing roller which the cartridge supports.

10. The image forming apparatus according to claim 1, wherein the cartridge has a gripping portion, and wherein, when the cartridge is supported by the supporting member, the center of gravity of the cartridge is located on the upstream side of the gripping portion in the extracting direction.

* * * * *